US006026598A

United States Patent [19]

Aschenbrenner

[11] Patent Number: 6,026,598

[45] Date of Patent: Feb. 22, 2000

[54] CHILD'S BOOT WITH REFLECTIVE STRIPE

[75] Inventor: Lisa Aschenbrenner, Silver Lake, Kans.

[73] Assignee: Payless ShoeSource, Inc., Topeka, Kans.

[21] Appl. No.: 09/034,692

[22] Filed: Mar. 4, 1998

[51] Int. Cl.[7] ..... A43B 23/00

[52] U.S. Cl. ..... 36/137; 36/112

[58] Field of Search ..... 36/137, 112, 7.1 R, 36/7.3

[56] References Cited

U.S. PATENT DOCUMENTS

| | | | |
|---|---|---|---|
| 2,309,520 | 1/1943 | McCandlish | 36/7.3 |
| 4,188,737 | 2/1980 | Haver | 36/31 |
| 4,512,089 | 4/1985 | Carrier | 36/112 |
| 4,651,447 | 3/1987 | Sullivan | 36/137 |
| 4,712,319 | 12/1987 | Goria | 36/137 |
| 5,150,536 | 9/1992 | Strong | 36/7.1 R |
| 5,611,156 | 3/1997 | Chiu | 36/137 |
| 5,879,069 | 3/1999 | Chien | 36/137 X |

*Primary Examiner*—Ted Kavanaugh
*Attorney, Agent, or Firm*—Lathrop & Gage LC

[57] ABSTRACT

A child's footwear is disclosed and includes comprises-a boot member having a foot enclosing member and a lower leg encircling member attached to the foot enclosing member, a fastening mechanism having a strap and hook-and-loop fastener components for fastening the lower leg encircling member about the child's lower leg, and a signalling mechanism constructed of reflective material. The signalling mechanism has an elongate configuration in the form of an exclamation point and extends substantially from an upper extremity of the lower leg encircling member to a juncture between the lower leg encircling member and the foot enclosing member, a non-vertical orientation, and at least two rows of stitches, one of which is spaced along each side of the signalling mechanism such that the signalling mechanism is caused to bulge convexly outwardly between the two rows of stitches.

9 Claims, 1 Drawing Sheet

CHILD'S BOOT WITH REFLECTIVE STRIPE

BACKGROUND OF THE INVENTION

1. Field of the Invention

This invention relates generally to footwear and, more specifically without limitation, to footwear having a passive reflective device.

2. Description of the Related Art

It is well known that objects are sometimes difficult to see in subdued lighting situations. For example, a child walking across a crosswalk at an intersection at dusk may be difficult to see or may be seen too late to avoid seriously injuring the child. Although some footwear for children has attempted to provide some warning provisions, what is needed is a signalling mechanism that enhances noticeability of an exposed child to a driver in an oncoming vehicle.

SUMMARY OF THE INVENTION

An improved child's footwear comprising a boot member having a foot enclosing member, and a lower leg encircling member attached to the foot enclosing member, wherein the lower leg encircling member has a lateral side and a medial side.

The improved footwear also includes a fastening mechanism having a strap and hook-and-loop fastener components for fastening the lower leg encircling member about the child's lower leg, and a signalling mechanism constructed of reflective material. The signalling mechanism is connected to the lateral side of the lower leg encircling member and has an elongate configuration in the form of an exclamation point and extends substantially from an upper extremity of the lower leg encircling member to a juncture between the lower leg encircling member and the foot enclosing member, a non-vertical orientation, and at least two rows of stitches, one of which is spaced along each side of the signalling mechanism such that the signalling mechanism is caused to bulge convexly outwardly between the two rows of stitches.

PRINCIPAL OBJECTS AND ADVANTAGES OF THE INVENTION

The principal objects and advantages of the present invention include: providing a child's boot having a signalling mechanism with an elongate configuration constructed of reflective material; providing such a child's boot having an elongate signalling mechanism in the form of an exclamation point; providing such a child's boot having an elongate signalling mechanism extending substantially from an upper extremity of a lower leg encircling member to a juncture between the lower leg encircling member and a foot enclosing member thereof; providing such a child's boot having a signalling mechanism with a non-vertical orientation; providing such a child's boot having an elongate signalling mechanism with an central portion that bulges convexly outwardly; and generally providing such a child's boot is inexpensive to manufacture, reliable in performance, and particularly well adapted for the proposed usage thereof Other objects and advantages of the present invention will become apparent from the following description taken in conjunction with the accompanying drawings, which constitute a part of this specification and wherein are set forth exemplary embodiments of the present invention to illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
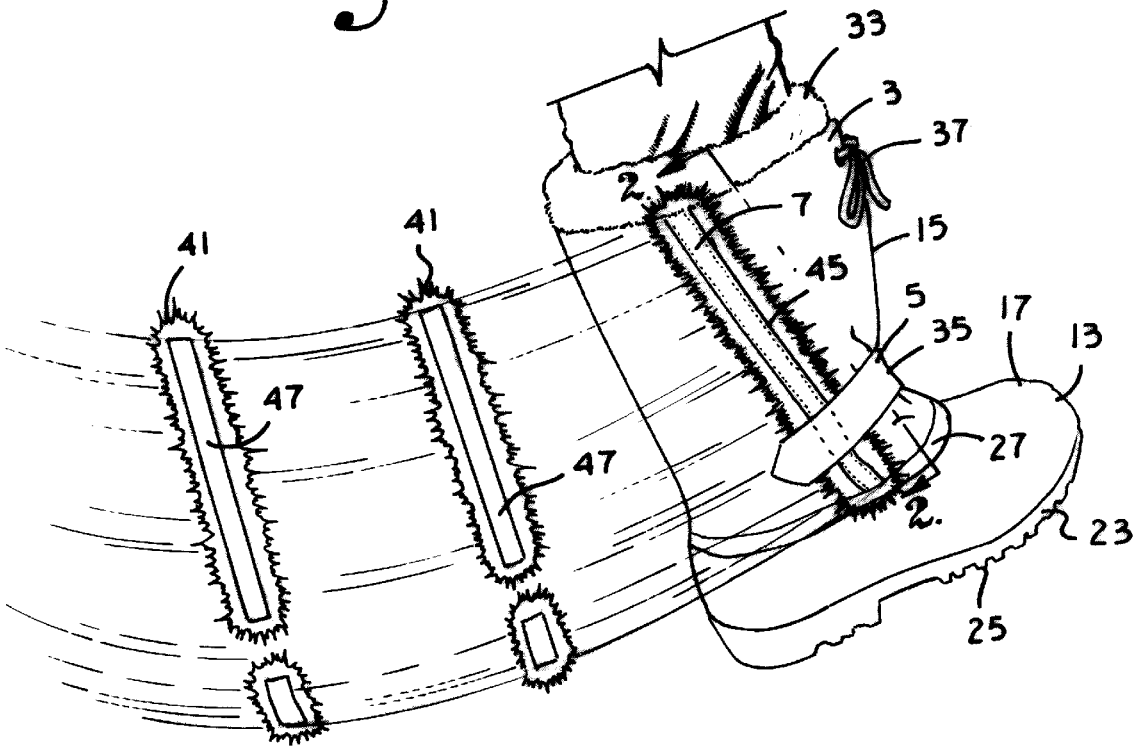
FIG. 1 is a perspective side view of a child's boot having reflective stripe, according to the present invention.
Figure 2:
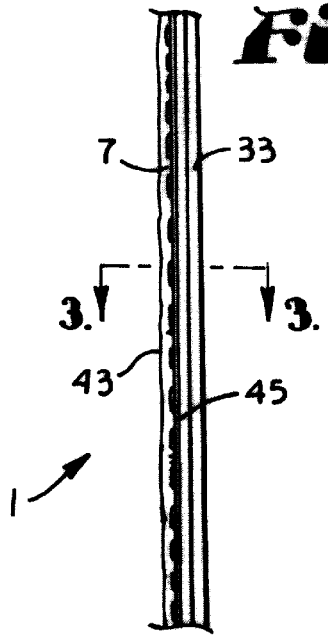
FIG. 2 is an enlarged and fragmentary, cross-sectional view of the child's boot having reflective stripe, taken along line 2—2 of FIG. 1.
Figure 3:
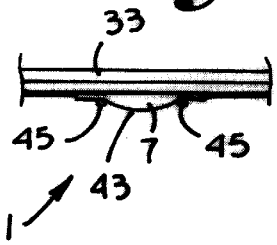
FIG. 3 is a further enlarged and fragmentary, cross-sectional view of the child's boot having reflective stripe, taken along line 3—3 of FIG. 2, according to the present invention.

The reference numeral 1 generally refers to a child's footwear in accordance with the present invention, as shown in FIGS. 1 through 3. The child's footwear 1 comprises a boot member 3, a fastening mechanism 5, and a signalling mechanism 7.

The boot member 3 generally includes a foot enclosing member 13 and a lower leg encircling member 15. The foot enclosing member 13 generally has an upper portion 17 and a lower portion 23, including a tread 25. The upper portion 17 and the lower portion 23 are generally molded from a water impermeable material, such as polyurethane or other suitable material, in order to provide a seamless, leakproof structure. It is to be understood, however, that the upper portion 17, the lower portion 23, and any combination thereof may be constructed non-unitarily with seams, so long as appropriate connections are provided therebetween such that a non-leaking enclosure is provided for a user's foot. The size of the foot enclosing member 13 may be constructed in any suitable size, which size is generally selected to correspond with or approximate a readily available commercial size.

The lower leg encircling member 15 may also be constructed unitarily with the foot enclosing member 13. Preferably, however, the lower leg encircling member 15 is constructed separately from the foot enclosing member 13. The lower leg encircling member 15 is then joined to the foot enclosing member 13, such as by stitching a lower extremity of the lower leg encircling member 15 to an upper extremity of the foot enclosing member 13, as shown in FIG. 1, or other suitable arrangement for joining the lower leg encircling member 15 to the foot enclosing member 13.

The lower leg encircling member 15 may be constructed of a single piece of material having a seamless structure, a single piece of material having a single seam, a plurality of pieces of a single type of material or a plurality of types of materials and/or colors, or other suitable arrangement as desired. The material selected for construction of the lower leg encircling member 15 should be waterproof or highly water resistant, such as nylon, or other suitable material which may also be treated with a water resistant or waterproofing substance.

It is to be understood that any seams thereof, including any seam between the lower leg encircling member 15 and the foot enclosing member 13, will be constructed and/or treated in such a manner that those seams are waterproof and leakproof, thereby providing a dry enclosure for the user's foot. If desired the joining of the lower leg encircling member 15 to the foot enclosing member 13 may include a material strip or bead 27 for decorative and/or reinforcing purposes.

If desired, the child's footwear 1 may include a liner 33. The liner 33 may be constructed of insulative material, such an thermal insulation provided by Minnesota Mining & Manufacturing Company ("3M") under the THINSULATE trademark, or other suitable material to provide year-round thermal comfort for the user's foot.

The lower leg encircling member 15 is constructed to have a vertical opening such that the user can readily slip his foot therethrough and into the foot enclosing member 13. The fastening mechanism 5 is operatively configured to compress the lower leg encircling member 15 above the ankle of the user's foot in order to minimize any tendency of the footwear 1 to work up and down relative to the ankle of the user's foot as the user walks with the footwear 1.

For example, the fastening mechanism 5 may include a strap 35 constructed of one cooperative component of a hook-and-loop fastener with the other cooperative component thereof secured to the lower leg encircling member 15, as suggested in FIG. 1. Alternatively, the strap 35 may be constructed of an elastic or inelastic material, with one cooperative component of a hook-and-loop fastener to one or both ends thereof with the other cooperative component thereof connected to the lower leg encircling member 15 to correspond with one or both ends of the strap 35, as appropriate.

If desired, the footwear 1 may also include another fastening mechanism 37 to minimize or eliminate entry of water into the footwear 1 through the top thereof, such as a drawstring threaded through a loop formed in an upper extremity of the lower leg encircling member 15 as shown in FIG. 1, or other suitable arrangement.

The signalling mechanism 7 is generally constructed of an elongate strip of reflective material, such as that provided by Minnesota Mining & Manufacturing Company ("3M") under the SCOTCHLITE trademark, or other suitable reflective material. The signalling mechanism 7 is configured to operative signal the presence of a child in subdued lighting when being approached by a lighted vehicle, as indicated by the aura designated by the numeral 41 in FIG. 1. The signalling mechanism 7 utilizes several features which singly provide such signal, or wherein one or more such features in combination substantially enhance the noticeability of that signal.

First, the signalling mechanism 7 is elongate vertically, extending substantially from the upper extremity of the lower leg encircling member 15 to the juncture between the lower leg encircling member 15 and the foot enclosing member 13. In other words, the vertical span of the signalling mechanism 7 is substantially maximized. As a result, as the user of the footwear 1 walks along, the area swept out by the signalling mechanism 7 during each walking stride of the user is also maximized. By so maximizing the area swept out by the signalling mechanism 7, the more noticeable is the signal reflected by the signalling mechanism 7 to an approaching vehicle.

Second, the signalling mechanism 7 is constructed of flexible material and is attached, secured or connected to the lower leg encircling member 15 such that a longitudinally central portion 43 thereof, see FIG. 2, bulges convexly outwardly from the lower leg encircling member 15, as shown in FIG. 3. For example, the signalling mechanism 7 may be secured by stitches 45 along each side thereof to the underlying lower leg encircling member 15, as shown in FIGS. 1 and 3. In that event, a slight excess of the signalling mechanism 7 may be crowded toward the center during installation thereof to enhance the outward bulging, or the softness, compressibility, etc., of the signalling mechanism 7 may automatically cause outward bulging between the rows of stitching. At any rate, the outward bulging of the signalling mechanism 7 provides a greater angle of viewability thereof than would a similar signalling mechanism having a planar surface that does not bulge convexly outwardly between opposing sides thereof.

Third, the signalling mechanism 7 generally has a non-vertical orientation when the user is standing still. Needless to say, most objects having straight boundaries usually have those boundaries oriented either vertically or horizontally. Thus, if the signalling mechanism 7 were oriented vertically, then a person in an oncoming vehicle might mentally mistake the signalling mechanism 7 as some naturally occurring boundary and not as readily notice the signalling mechanism 7 as he would if the signalling mechanism 7 were askew as taught herein. In other words, the non-vertical orientation of the signalling mechanism 7 may enhance the noticeability thereof even though the user may be standing still.

Four, the fastening mechanism 5 is configured to cross over the signalling mechanism 7, as shown in FIG. 1, giving the elongate signalling mechanism 7 the appearance of a commonly and readily recognizable exclamation point 47. As a result, the oncomer is not only exposed to the reflective nature of the signalling device 7, but the novelty of the signalling mechanism 7 enhances the noticeability thereof due to the oncomer mentally noting the unique exclamation-point design of the signalling mechanism 7, particularly when the "exclamation point" 47 follows a periodic arcuate trajectory as the user walks along.

It is to be understood that the signalling mechanism 7 may be spaced only on the medial side of each of the footwear 1 worn by the user or, alternately, the signalling mechanism 7 may be spaced on both the medial side and the lateral side of each of the footwear 1 worn by the user.

It is to be understood that while certain forms of the present invention have been illustrated and described herein, it is not to be limited to the specific forms or arrangement of parts described and shown.

What is claimed and desired to be secured by Letters Patent is as follows:

1. Footwear for a user, comprising:

(a) a foot enclosing member;

(b) a lower leg encircling member attached to said foot enclosing member, said lower leg encircling member having a lateral side and a medial side;

(c) an elongate signalling mechanism connected to said lateral side of said lower leg encircling member, said signalling mechanism having a non-vertical orientation and extending substantially from an upper extremity of said lower leg encircling member to a juncture between said lower leg encircling member and said foot enclosing member; and (d) a fastening mechanism for fastening said lower leg encircling member about the user's leg, said fastening member being operatively configured to extend across said elongate signalling member in a substantially perpendicular manner near the juncture between said lower leg encircling member and said foot enclosing member such that the elongate signalling mechanism has the configuration of an exclamation point.

2. The footwear of claim 1, wherein said footwear is a boot.

3. The footwear of claim 1, wherein said lower leg encircling member is constructed of nylon.

4. The footwear of claim 1, wherein said fastening mechanism includes:

(a) a strap constructed of one component of a hook-and-loop fastener; and (b) at least one attachment constructed of the other component of said hook-and-loop fastener secured to said lower leg encircling member.

5. The footwear of claim 4, wherein said strap is constructed of elastic material.

6. The footwear of claim 1, wherein said fastening mechanism includes:

(a) a strap; (b) at least one first attachment constructed of one component of a hook-and-loop fastener, wherein said at least one first attachment is connected to said strap; and (b) at least one second attachment constructed of the other component of said hook-and-loop fastener, wherein said at least one second attachment is correspondingly secured to said lower leg encircling member.

7. The footwear of claim 1, wherein said signalling mechanism is constructed of reflective material.

8. The footwear of claim 1, wherein said signalling mechanism is connected to said lower leg enclosing member by at least two rows of stitches, one of said at least two rows of stitches spaced along each side of said signalling mechanism.

9. The footwear of claim 8, wherein said stitches causes said signalling mechanism to bulge convexly outwardly between said at least two rows of stitches.

* * * * *